United States Patent [19]

Will et al.

[11] 4,051,339

[45] Sept. 27, 1977

[54] VARIABLE TIME MISSILE SAFETY TIMER

[75] Inventors: Albert S. Will, Bethesda; Robert R. Wilson, Chillum; Paul L. Culver, Ellicott City, all of Md.

[73] Assignee: The United States of America as represented by the Secretary of the Navy, Washington, D.C.

[21] Appl. No.: 423,644

[22] Filed: Dec. 28, 1964

[51] Int. Cl.[2] ..... H01H 3/32

[52] U.S. Cl. ..... 200/153 L; 102/83; 200/33 B

[58] Field of Search ..... 102/82, 83, 70.2; 200/27, 30, 68, 77, 38, 41, 153.11, 43; 74/53, 55, 56, 57

[56] References Cited

U.S. PATENT DOCUMENTS

| | | | |
|---|---|---|---|
| 1,273,873 | 7/1918 | Kollock et al. | 74/56 |
| 2,626,997 | 1/1953 | Thomas | 200/202 |
| 2,958,282 | 11/1960 | Czajkowski et al. | 244/3.14 |

*Primary Examiner*—David H. Brown
*Attorney, Agent, or Firm*—R. S. Sciascia; A. L. Branning

EXEMPLARY CLAIM

1. A variable delay arming timer comprising
   a cylindrical housing,
   a motor and gearing contained within said housing,
   a shaft coupled to said gearing to be rotated thereby at a predetermined rate, said shaft being coaxial with said cylindrical housing,
   cam means mounted on said shaft for rotation therewith,
   snap-action switch means carried by said housing and controlled by said cam means, said snap-action switch means having at least one spring biased actuating rod controlled between a retracted switch open position to an advanced switch-closed position by means of said cams, said rod being carried by said housing and being arranged in parallel relationship to said shaft and radially displaced from said shaft by a distance greater than the radius of said cylindrical housing, and
   switch carrying discs surrounding said cylindrical housing in coaxial relation thereto, said discs carrying switch elements in position to be actuated by said actuating rods.

5 Claims, 4 Drawing Figures

INVENTORS
ALBERT S. WILL
ROBERT R. WILSON
PAUL L. CULVER

BY M. J. Moorfield ATTORNEY
Robert P. Williams AGENT

VARIABLE TIME MISSILE SAFETY TIMER

The invention described herein may be manufactured and used by or for the Government of the United States of America for governmental purposes without the payment of any royalties thereon or therefor.

This invention relates to the art of the arming of ordnance missiles. More particularly, the invention relates to a variable delay arming timer for a missile.

The invention to which the present application is directed was developed as part of an antisubmarine weapon system designed to be launched from a torpedo tube of an attack submarine to fly a water-air-water trajectory to the vicinity of a target. Although it will be clear from the detailed description to follow that it may be employed with any ordnance missile using delayed arming or as a timer of general application.

This weapon may be provided with a nuclear warhead and for this reason it is necessary to incorporate many safety features for the protection of the launching submarine and friendly forces in its vicinity as well as those located beyond the target. One of the conditions which has to be met in order to satisfy the safety requirements is that the operation of the arming and safing device be uniquely connected with the missile environment after launch. In order to meet this objective, a safety system was developed which employs a variable timer, the delay time being established in proportion to the known range of a particular target, combined with an impact detector to sense the impact of the weapon on the water surface and arm the weapon only in the event that the flight time set into the timer had been exceeded by the missile. This system per se is the invention of Albert S. Will and Robert R. Wilson and has been disclosed and claimed in patent application Ser. No. 423,642, entitled "Variable Range Time Impact Safety System," filed of even date herewith.

The present application is directed to the delay timer itself. While the timer as described herein has particular structure which adapts it to the system of the above-identified application, it is to be understood that the present invention is not limited to such structure. For example, the particular program of the arming operation is variable at will so that the timer is readily adaptable to other arming systems, than that mentioned above, as well as to timing devices in general.

An object of the present invention is to provide a variable delay arming timer which can be preset in a convenient manner by apparatus connected with the fire control and launching mechanism. To this end, the timer employs an electric motor to perform two functions. First, prior to launch, the motor is connected into the diagonal of a rebalancing servo loop controllable from the fire control system to establish the desired delay time corresponding to the desired range. Secondly, upon launching of the missile and initiation of the time interval of the timer, the same motor is used to drive the timer itself.

Another object of the invention is to provide a variable delay arming timer having rugged, shock-proof arming switches and which is highly adaptable to variations in the switch arrangements used therewith.

Another object of the invention is to provide a variable timer for an arming and fuzing system of a missile, which may be continuously set at all times up to the moment of launch and in which contact wear in setting has been eliminated.

A further object of the invention is to provide a variable delay arming timer having snap-action arming switch means and in which the timer contacts are essentially locked after arming.

Other objects, advantages and new features will be apparent from a consideration of the following detailed description when considered in conjunction with the accompanying drawings wherein.

Figure 1:
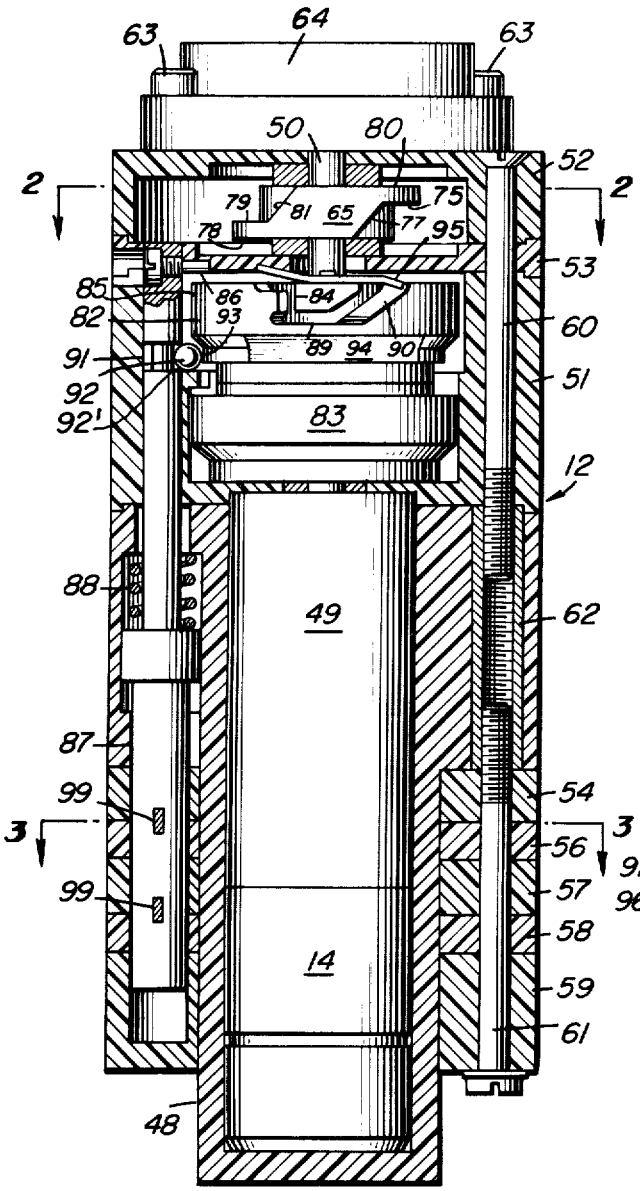
FIG. 1 is a cross-sectional elevational view of the timer.

Referring now to FIG. 1, the timer of the present invention is generally designated at 12 and consists of an electrical motor 14 contained within a suitable, generally cylindrical plastic housing 48. Electrical leads have been omitted from FIG. 1 for purposes of clarity. Motor 14 is coupled to an output shaft 50, coaxial with housing 48, through a high ratio reduction gearing system 49. Housing 48 is a molded plastic body and has provision thereon for the attachment of a continuation housing portion 51 and various switch support elements 52, 53, 54, 56, 57, 58 and 59. All of these elements are made of a suitable plastic material and are secured together in stacked relation by means of screws such as those shown at 60 and 61, which engage and internally threaded sleeve secured in housing 48. At the upper end of the structure in FIG. 1 and secured to support 52 by means of suitable fasteners 63 is a housing 64 for a potentiometer which constitutes a portion of the setting system of the present timer. It is to be understood, of course, that although the specific structure is not shown in FIG. 1, that shaft 50 enters the potentiometer housing 64 and actuates a movable wiper therein in response to inputs from the transmitting potentiometers located at a point remote from the timer.

Figure 2:
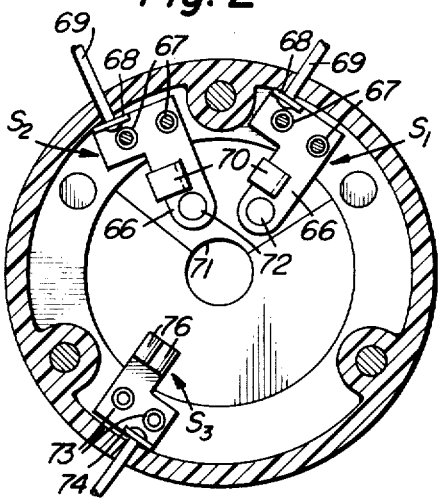
FIG. 2 is a section taken on line 2—2 of FIG. 1.
Figure 4:
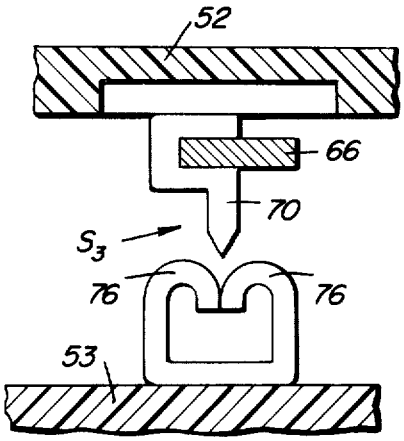
FIG. 4 is a detailed showing of one of the types of switch used in the present device.

Certain of the switches, designated in FIG. 2 as $S_1$, $S_2$ and $S_3$, are directly cam operated by means of a cam 65 which is fixed on shaft 50 to rotate therewith. Each of switches $S_1$, $S_2$ and $S_3$ is an opposed leaf spring knife switch having the knife thereof on one side and the spring finger stationary contact on the other as indicated in FIG. 4. As should be apparent from a consideration of FIGS. 1, 2 and 4, half of the elements of each of switches $S_1$, $S_2$ and $S_3$ is mounted on element 53. The opposite elements of each of switches are mounted on element 52. Switches $S_1$ and $S_2$ illustrate in FIG. 2 the knife portion of the switches. Each comprises an L-shaped leaf spring blade 66 secured to element 53 by means of suitable rivets 67. Electrical connection is established to the switches by means of an upstanding lug 68 on each L-shaped leaf spring to which a suitable lead 69 is soldered. Knives 70 are secured to blades 66 in upstanding relation thereto in any suitable manner. Blades 66 overly an undercut recess 71 to allow for flexure of the blades. The free ends of the blades terminate in cam follower hemispheres 72.

Switch $S_3$ in FIG. 2 illustrates the structure of the stationary contact. For this, reference is also directed to FIG. 4. The stationary contact again consists of an L-shaped blade secured to the base of element 53 by means of suitable rivets 73. Electrical connection is made to upstanding lugs 74 and the free end of the L-shaped member terminates in opposed spring fingers 76 which are engaged by the knife 70 of the opposite member when the switch is in the closed position. As indicated above, these switches are controlled between their open and closed positions by means of cam 65 on shaft 50. For this purpose cam 65 is provided with a surface 75, a ramp 77 and surface 78 for operating switches $S_1$ and $S_2$, while on the opposite side of the cam and used to operate switch $S_3$ are a second set of surfaces and ramp, in this case, surface 79, ramp 81 and surface 80. It is here noted that the locations of these surfaces on the cam as shown in FIG. 1 are illustrative only and that the angular location of the ramps 77 and 81 may be varied at will to suit the needs of the particular programming operation that the switches are intended to perform.

It should be clear from a consideration of the structure of cam 65 that the operation of the various switches is as follows. When surface 75 on cam 65 overlies the follower 72 of switches $S_1$ and $S_2$, the switches are in their uppermost or opened position. Upon rotation of ramp 77 and surface 78 past the switch elements, the switches are moved to their lowermost position and retained there. Surfaces 79 and 80 and ramp 81 act in a similar manner to operate the movable contact of switch $S_3$.

Figure 3:
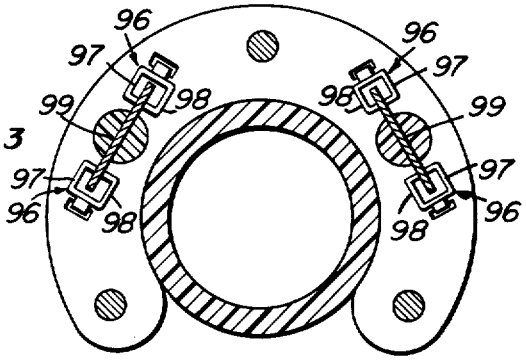
FIG. 3 is a section taken on line 3—3 of FIG. 3.

As indicated above, the primary arming switches of the present delay timer are cam operated snap-action switches. One typical switch is shown in FIGS. 1 and 3, and it is to be understood that other switches may be provided which are constructed in the same manner. The switches per se are operated by an actuating rod 87 constructed of an electrically insulating material which is controlled between a retracted or switch-open position by means of a timing cam 82 and is projected forward to the extended or switch-closed position by action of a spring 88. The cam as shown in FIG. 1 at 82 is typical and it is to be understood that a cam configuration similar to that shown will be used to actuate or control each of the rods 87. An additional cam disc 83 may be employed if necessary. Each of the cam discs is secured to shaft 50 for rotation therewith, and each serves to control the position of its associated switch actuating rod 87. Each rod 87 is disposed in parallel relation to the axis of shaft 50 and is provided with a cam follower pin 86 threadedly secured thereto and extending tranversely out over the edge of the cam disc into overlying relation with plane radial surface 85 on the cam disc. As shown, rod 87 is radially spaced from the shaft by a distance greater than the radius of housing 48.

The construction of the cam slot itself in cam 82 is as follows. First, there is a drop-in slot 84 into which cam follower 86 of rod 87 will fall under the action of spring 88 when the drop-in slot has been rotated to the angular position of rod 87. A horizontal slot 89 then connects the bottom of drop-in slot 84 with a resetting ramp 90 which returns rod 87 to its uppermost position after an additional time determined by the angular extent of slot 89 and the slope of ramp 90. It will be appreciated from a consideration of the disclosure of the related patent application referred to above that the angular extent of slot 89 is chosen to provide a particular interval of time during which the timer remains in the armed condition if it is not stopped within that time. It will be understood that in a timer of general application the angular extent of slot 89 is not material and the resetting ramp could begin right at the bottom of drop-in slot 84.

Means are provided for holding the respective cam followers above the surface of the cam discs during the resetting portion of the cycle of operation of the device in order to prevent wear on the cam followers. In the application of the device to the system of the related application, the timer may be continuously reset or undergoing the resetting operation for periods of days. It has been found that unless some precaution is taken to reduce wear, failure of the timer may result. The means for this purpose consists of a reduced diameter portion 91 on rod 87, defining a shoulder 92' which cooperates with a ball 92 biased toward rod 87 by means of a cam surface 93 on cam 82. Just prior to the arrival of drop-in slot 84 at the angular position of rod 87, a recessed portion 94 begins which allows ball 92 to be biased away from rod 87 by the downward action of spring 88. After rod 87 has been reset by ramp 90, ball 92 is again biased to the left in FIG. 3 to raise follower 87 off the surface of the cam once again.

In order to prevent the cam follower from entering the cam slots in the event that the device is inadvertently rotated too far counterclockwise, a leaf spring element 95 is secured to the top surface of disc 82 and overlies the cam slots 84 and 90. Leaf spring 95, in its unstressed condition, is depressed somewhat into slot 90 so as to permit the cam follower to ride up on the top surface of spring 95 when the cam is operating in a counterclockwise direction. The opposite end of leaf spring 95 is bent above the top surface of cam 82 in order to allow cam follower 86 to pass below spring 95 to drop into drop-in slot 84 when operating in the normal or clockwise direction.

The switch element themselves which are actuated by the rods 87 are carried by horseshoe shaped discs 54, 56, 57, 58 and 59 coaxial with housing 48 as shown in FIGS. 1 and 3. These discs are horseshoe shaped to provide space for electrical wiring for the timer (not shown). The stationary contacts 96, FIG. 3, of the various switches are formed from sheet stock and are shaped to provide opposed spring fingers 97 and 98, respectively. In order to bridge between fingers 97 and 98 to connect contacts 96 electrically to one another, rod 87 is provided with a transversely extending shorting bar 99 which in the uppermost position of rod 87 is withdrawn from a position between the spring finger elements of the contacts 96 and in the lower position of rod 87 is pressed between these fingers. Each actuating rod 87 may carry a plurality of shorting bars 99, two such bars being shown in FIG. 1. The number of switches actuated by a particular rod is limited only by design considerations.

The operation of the device should now be readily apparent. As indicated above, motor 14 has a dual function in the present device. During the setting operation, motor 14 acts as a rebalancing motor in the rebalancing servo system to position the wiper of the potentiometer contained within housing 64 to set the timer to the desired time delay. When the servo system becomes unbalanced due to a setting of the transmitter potentiometer at the remote control station, the motor operates to rotate the cams to an angular position such that the time required for drop-in slot 84 to rotate around to the position of the actuating rods 87 is the desired time delay. After the setting operation is complete, the motor 14 is connected to a regulated power supply to run as a clock motor to cause the timing cycle to take place. When drop-in slot 84 arrives at the position of rod 87, cam follower 86 drops into drop-in slot 84, thus closing the switches.

Among other things, the timer of the present invention has the following advantages. First, arming time delays can be set in proportion to the range of the missile which is utilizing the timer. This results in safety for the missile launching platform which increases with range. The primary arming switches are positive in action, rugged and reliable. Wear is reduced to insignificance by the use of the cams and the means for raising the cam follower 86 off the surface of the cam during most of the setting operation. By reason of leaf spring 96, the device is protected from damage when being tested by rotating the cams inadvertently in the counterclockwise direction. In addition it prevents pre-mature arming by inadvertent stray voltage which might drive the timer in the wrong direction into the armed zone prematurely.

In addition, the compactness of the present timer is important to the art of missile arming, space being at a premium in modern missiles. Compactness is achieved primarily by arranging the switch actuating rods parallel to the axis of the motor and gearing system and closely adjacent the peripheries of the cam discs. The arrangement of the switches on the horseshoe shaped discs, also coaxial with the motor, is also within this compactness concept.

The device is subject to many modifications as will be readily apparent to those skilled in the art. For example, the remote control setting mechanism may be eliminated and the timer set by hand by rotating the cams or by manually connecting a power supply to motor 14. Accordingly, it is to be understood that within the scope of the appended claims the invention may be practiced otherwise than as specifically described.

What is claimed is:

1. A variable delay arming timer comprising a cylindrical housing, a motor and gearing contained within said housing, a shaft coupled to said gearing to be rotated thereby at a predetermined rate, said shaft being coaxial with said cylindrical housing, cam means mounted on said shaft for rotation therewith, snap-action switch means carried by said housing and controlled by said cam means, said snap-action switch means having at least one spring biased actuating rod controlled between a retracted switch open position to an advanced switch-closed position by means of said cams, said rod being carried by said housing and being arranged in parallel relationship to said shaft and radially displaced from said shaft by a distance greater than the radius of said cylindrical housing, and switch carrying discs surrounding said cylindrical housing in coaxial relation thereto, said discs carrying switch elements in position to be actuated by said actuating rods.

2. A variable delay arming timer as recited in claim 1, wherein said actuating rod is at least partially constructed of an electrically insulating material and has a shorting bar extending transversely therethrough, said switch elements comprising a pair of contacts disposed on diametrically opposite sides of said actuating rod, said contacts each having opposed spring fingers thereon between which said shorting bar is pressed when said actuating rod is advanced to the switch-closed position, whereby a conductive path is established between said contacts.

3. A variable delay arming timer as recited in claim 1 wherein said cam means comprises at least one cylindrical cam disc fixed on said shaft and coaxial therewith, said cam disc having a plane surface thereon normal to the axis of said shaft, a drop-in slot extending a predetermined distance along the periphery of said cam disc from said plane surface in a direction parallel to the axis of said shaft and resetting ramp coupling the end of said drop-in slot back to said plane surface, said actuating rod having a cam follower thereon, said follower comprising a pin extending transversely from said actuating rod and lying adjacent said plane surface to define the switch open position, the length of said drop-in slot being the distance of travel of said actuating rod from the switch open to the switch closed position, whereby said actuating rod is retained in the switch open position when said cam follower lies adjacent said plane surface under the action of said spring, is moved to the switch-closed position when said follower enters said drop-in slot after said predetermined time delay and is returned to the switch open position upon further rotation of said cam by said resetting ramp.

4. A timer as defined in claim 3, wherein means are provided for eliminating wear on said cam follower during setting operations of said timer, said means comprising a reduced diameter portion on said switch actuating rod defining a shoulder thereon, said shoulder being located adjacent the periphery of said cam disc when said actuating rod is in the switch open position, a ball confined in said housing and cooperable with said shoulder to raise said cam follower off said plane surface when biased toward said actuating rod, and cam means on said cam disc for pressing said ball toward said actuating rod and for allowing said ball to move away from said actuating rod when said drop-in slot and said resetting ramp are adjacent said actuating rod.

5. A timer as defined in claim 3, wherein a leaf spring is secured to said cam disc in overlying relation to said drop-in slot and said resetting ramp, said leaf spring in its unflexed condition being depressed into the resetting ramp and raised above said drop-in slot, whereby when said cam disc is rotated inadvertently in the reverse of its normal direction past said actuating rod, said cam follower is prevented from entering said resetting ramp and said drop-in slot and is carried thereover by said leaf spring.

* * * * *